US008922448B2

(12) United States Patent
Wong et al.

(10) Patent No.: US 8,922,448 B2
(45) Date of Patent: Dec. 30, 2014

(54) COMMUNICATION DEVICE AND ANTENNAS WITH HIGH ISOLATION CHARACTERISTICS

(71) Applicants: MediaTek Singapore Pte. Ltd., Singapore (SG); National Sun Yat-sen University, Kaohsiung (TW)

(72) Inventors: Kin-Lu Wong, Kaohsiung (TW); Yi-Ting Hsieh, Huatan Township, Changhua County (TW); Po-Wei Lin, Taichung (TW); Shih-Huang Yeh, Hsinchu (TW); Ting-Wei Kang, Kaohsiung (TW)

(73) Assignees: MediaTek Singapore Pte. Ltd., Singapore (SG); National Sun Yat-Sen University, Kaohsiung (TW)

( * ) Notice: Subject to any disclaimer, the term of this patent is extended or adjusted under 35 U.S.C. 154(b) by 192 days.

(21) Appl. No.: 13/627,311

(22) Filed: Sep. 26, 2012

(65) Prior Publication Data

US 2014/0085158 A1 Mar. 27, 2014

(51) Int. Cl.
*H01Q 1/52* (2006.01)
*H01Q 1/24* (2006.01)

(52) U.S. Cl.
USPC ..... 343/841; 343/702

(58) Field of Classification Search
CPC ..... H01Q 1/521; H01Q 1/243; H01Q 1/48
USPC ..... 343/841, 702
See application file for complete search history.

(56) References Cited

U.S. PATENT DOCUMENTS 6,624,789 B1 9/2003 Kangasvieri et al.
6,624,790 B1 9/2003 Wong et al.
7,289,068 B2 10/2007 Fujio et al.

(Continued)

FOREIGN PATENT DOCUMENTS

DE 10 2008 037 836 6/2009
DE 10 2011 052 130 8/2012

(Continued)

OTHER PUBLICATIONS

IEEE Standard for Information Technology—Telecommunications and Informations Exchange Between Systems—Local and Metropolitan Area Networks-Specific Requirements—Part 11: Wireless LAN Medium Access Control (MAC) and Physical Layer (PHY) Specifications Amendment 5: Enhancements for Higher Throughput.

(Continued)

*Primary Examiner* — Hoang V Nguyen
(74) *Attorney, Agent, or Firm* — McClure, Qualey & Rodack, LLP

(57) ABSTRACT

A communication device includes a system circuit board, a ground plane, a first antenna, a second antenna, a first metal element, and a second metal element. The ground plane is disposed on the system circuit board. The first metal element is substantially located between the first antenna and the second antenna. The first metal element is coupled to the ground plane such that a system ground plane is formed. The second metal element is adjacent to the first metal element and substantially located between the first antenna and the second antenna. The second metal element is coupled to the system ground plane. The first antenna, the second antenna, and the first metal element are substantially located at an edge of the system circuit board.

20 Claims, 11 Drawing Sheets

(56) References Cited

U.S. PATENT DOCUMENTS

| | | | | |
|---|---|---|---|---|
| 7,557,762 | B2 | 7/2009 | Shimasaki et al. | |
| 7,561,111 | B2 | 7/2009 | Yu | |
| 7,609,221 | B2 * | 10/2009 | Chung et al. | 343/841 |
| 7,636,065 | B2 * | 12/2009 | Ohishi et al. | 343/702 |
| 8,144,063 | B2 * | 3/2012 | Schlub et al. | 343/702 |
| 8,405,553 | B2 | 3/2013 | Pintos et al. | |
| 2009/0128425 | A1 | 5/2009 | Kim et al. | |
| 2012/0194391 | A1 | 8/2012 | Liu et al. | |
| 2012/0212389 | A1 | 8/2012 | Aizawa et al. | |
| 2012/0214424 | A1 | 8/2012 | Yeh et al. | |
| 2013/0147676 | A1 * | 6/2013 | Chang et al. | 343/841 |

FOREIGN PATENT DOCUMENTS

| | | |
|---|---|---|
| EP | 2 006 953 | 12/2008 |
| EP | 2 256 866 | 12/2010 |
| EP | 2 328 228 | 6/2011 |
| EP | 2 360 782 | 8/2011 |
| EP | 2 546 922 | 1/2013 |
| EP | 2 575 207 | 4/2013 |
| FR | 2 942 676 | 9/2010 |
| JP | 2006-42111 | 2/2006 |
| JP | 2009-246560 | 10/2009 |
| KR | 1020100113938 | 10/2010 |
| WO | WO 2004/105182 | 12/2004 |
| WO | WO 2007/126897 | 11/2007 |
| WO | WO 2009/101417 | 8/2009 |
| WO | WO 2011/028801 | 3/2011 |
| WO | WO 2011/087177 | 7/2011 |
| WO | WO 2011/140653 | 11/2011 |
| WO | WO 2011/153640 | 12/2011 |
| WO | WO 2012/071842 | 6/2012 |

OTHER PUBLICATIONS

Wu, T.Y, et al.; "A Printed Diversity Dual-Band Monopole Antenna for WLAN Operation in the 2.4- and 5.2-GHz Bands;" Microw. Opt. Technol. Lett; 36; Sep. 2002; pp. 436-439.

Wong, K.L., et al.; "A Printed Ultra-Wideband Diversity Monopole Antenna;" Microw. Opt. Technol. Lett; 38; Jan. 2003; pp. 257-259.

Wong, K.L., et al.; "Internal Mobile Phone Antenna Array for LTE/WWAN and LET MIMO Operations;" Microw. Opt. Lett.; 53; Sep. 2010; pp. 1569-1573.

Wong, K.L., et al.; "Internal WWAN/LTE Handset Antenna Integrated with USB Connector;" Microw. Opt. Technol. Lett.; 54; Jul. 2011; pp. 1154-1159.

Kang, T.W., et al.; "Isolation Improvement of 2.4/5.2/5.8GHz WLAN Internal Laptop Computer Antennas Using Dual-Band Strip Resonator as a Wavetrap;" Microw. Opt. Technol. Lett.; 52; Apr. 2009; pp. 58-64.

Wong, K.L., et al.; "Three-Antenna MIMO System for WLAN Operation in a PDS Phone;" Microw. Opt. Technol. Lett.; 48; Dec. 2005; pp. 1238-1242.

Wu, T.Y., et al.; "Printed Diversity Monopole Antenna for WLAN Operation;" Electronics Letter; vol. 38; No. 25; Dec. 2002; pp. 1625-1626.

Wong, K.L., et al.; "Diversity Dual-Band Planar Inverted-F Antenna for WLAN Operation;" Microw. Opt. Technol. Lett.; 38; pp. 223-225.

Wong, K.L., et al.; "Simple Printed Monopole Slot Antenna for WWAN Mobile Handset" Antenna Technology International Workshop; Mar. 2011; pp. 7-9.

Sharawi, M.S., et al.; "A Dual-Element Dual-Band MIMO Antenna System with Enhanced Isolation for Mobile Terminals;" IEEE Antennas and Wireless Propagation Letters; vol. 11; Aug. 2012; pp. 1006-1009.

Hsieh, C.P., et al.; "Isolation Improvement between Antennas with Band-stop Structures;" Microwave Conference; Dec. 2008; pp. 1-20.

Sharawi, M.S., et al.; "An 800 MHz 2x1 Compact MIMO Antenna System for LTE Handsets;" IEEE Transactions on Antennas and Propagation; vol. 59; No. 8; Aug. 2011; pp. 3128-3131.

Zhou, X., et al.; "A Dual-Broadband MIMO Antenna System for GSM/UMTS/LTE and WLAN Handsets;" IEEE Antennas and Wireless Propagation Letters; vol. 11; 2012; pp. 551-554.

Su, S.W., et al.; "Printed Two Monopole-Antenna System with a Decoupling Neutralization Line for 2.4-GHz MIMO Applications;" Microw. Opt. Technol. Lett.; 53; Dec. 2010; pp. 2037-2043.

Su, S.W., et al.; "Printed MIMO-Antenna System Using Neutralization-Line Technique for Wireless USB-Dongle Applications;" IEEE Transactions on Antenna and Propagation; vol. 60; No. 2; Feb. 2012; pp. 456-463.

Li, Z. et al - "Compact Dual-Band MIMO Antenna for 4G Dongle Applications;" Microw. Opt. Technol. Lett.; 54; May 2011; pp. 744-748.

Su., S.W., et al.; "Internal Broadband Diversity Dipole Antenna;" Microw. Opt. Technol. Lett.; 49; Aug. 2006; pp. 810-812.

Lee, J., et al.; "Miniature Long-Term Evolution (LTE) MMO Ferrite Antenna;" IEEE Antennas and Wireless Propagation Letters; vol. 10, 2011; pp. 603-606.

Yu, B., et al.; "Closely Mounted Compact Wideband Diversity Antenna for Mobile Phone Applications;" International Journal of Antennas and Propagation; 2012; pp. 1-6.

Chi, G., et al.; "Dual-Band Printed Diversity Antenna for 2.4/5.2-GHz WLAN Application;" Microw. Opt. Technol. Lett.; 45; Dec. 2004; pp. 561-563.

Ding, Y., et al.; "A Novel Dual-Band Printed Diversity Antenna for Mobile Terminals;" IEEE Transactions on Antennas and Propagation; vol. 55; No. 7; Jul. 2007; pp. 2088-2096.

Yang, C., et al.; "Novel Compact Multiband MIMO Antenna for Mobile Terminal;" International Journal of Antennas and Propagation; 2012; pp. 1-10.

Chebihi, A., et al.; "A Novel Isolation Technique for Closely Spaced PIFAs for UMTS Mobile Phones;" IEEE Antennas and Wireless Propagation Letters; vol. 7; 2008; pp. 665-668.

Liu, W., et al.; "A Compact Wideband Planar Diversity Antenna for Mobile Handsets;" Microw. Opt. Technol. Lett.; 50; Jun. 2007; pp. 87-91.

Chung, K., et al.; "Integrated MIMO Antenna with High Isolation Characteristic;" Electronics Letters; vol. 43; Feb. 2007; pp. 19-201.

Cai, Y., et al.; "A Novel Wideband Diversity Antenna for Mobile Handsets;" Microw. Opt. Technol. Lett.; 51; May 2008; pp. 218-222.

Karaboikis, M., et al.; "Compact Dual-Printed Inverted-F Antenna Diversity Systems for Portable Wireless Device;" IEEE Antennas and Wireless Propagation Letters; vol. 3; 2004; pp. 9-14.

Zhang, S., et al.; "Ultrawideband MIMO/Diversity Antennas with a Tree-Like Structure to Enhance Wideband Isolation;" IEEE Antennas and Wireless Propagation Letters; vol. 8, 2009; pp. 1279-1282.

Lin, S.Y., et al.; "Small Inverted-U Loop Antenna for MIMO Applications;" Process in Electromagnetics Research C; vol. 34; 2013; pp. 69-84.

English language translation of abstract of JP 2009-246560 (published Oct. 22, 2009).

English language translation of abstract of JP 2006-42111 (published Feb. 9, 2009).

Antenova M2M Far Field House Queen Mary University of London; "Antenna Designs for MIMO Systems;" 2004; pp. 1-126.

Kim, K.J., et al.; "The High Isolation Dual-Band Inverted-F Antenna Diversity System with the Small N-Section Resonators on the Ground Plane;" Microw. Opt. Tecnol. Lett.; 49; Jul. 2006; pp. 731-734.

* cited by examiner

COMMUNICATION DEVICE AND ANTENNAS WITH HIGH ISOLATION CHARACTERISTICS

BACKGROUND OF THE INVENTION

1. Field of the Invention

The invention generally relates to a communication device, and more particularly, relates to a communication device comprising antennas with high isolation characteristics.

2. Description of the Related Art

As people demand more and more signal transmissions and higher transmission rates thereof, communication standards are supporting higher and higher data transmission rates. An antenna system with multiple antennas is required to be capable of receiving and transmitting signals at the same time. For example, the communication standard of IEEE 802.11n can support a MIMO (Multi-Input Multi-Output) operation to increase transmission rates. As a matter of fact, it is a future trend to use multiple antennas in a single mobile device. Since multiple antennas are disposed in a limited space of a mobile device, these antennas are very close to each other and result in serious interference therebetween. Thus, high isolation between the antennas is a critical challenge for a designer.

Accordingly, there is a need to design a new communication device, which not only has high isolation between antennas therein but also maintains radiation efficiency thereof, or even enhances radiation efficiency.

BRIEF SUMMARY OF THE INVENTION

In one exemplary embodiment, the disclosure is directed to a communication device, comprising: a system circuit board, having a first edge; a ground plane, disposed on the system circuit board; a first antenna, coupled to a first signal source, and operating in at least a first band; a second antenna, coupled to a second signal source, and operating in at least the first band; a first metal element, substantially located between the first antenna and the second antenna, wherein the first metal element is coupled to the ground plane such that a system ground plane is formed; and a second metal element, adjacent to the first metal element, substantially located between the first antenna and the second antenna, and coupled to the system ground plane; wherein the first antenna, the second antenna, and the first metal element are substantially located at the first edge of the system circuit board.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures thereof in the invention are shown in detail as follows.

Figure 1:
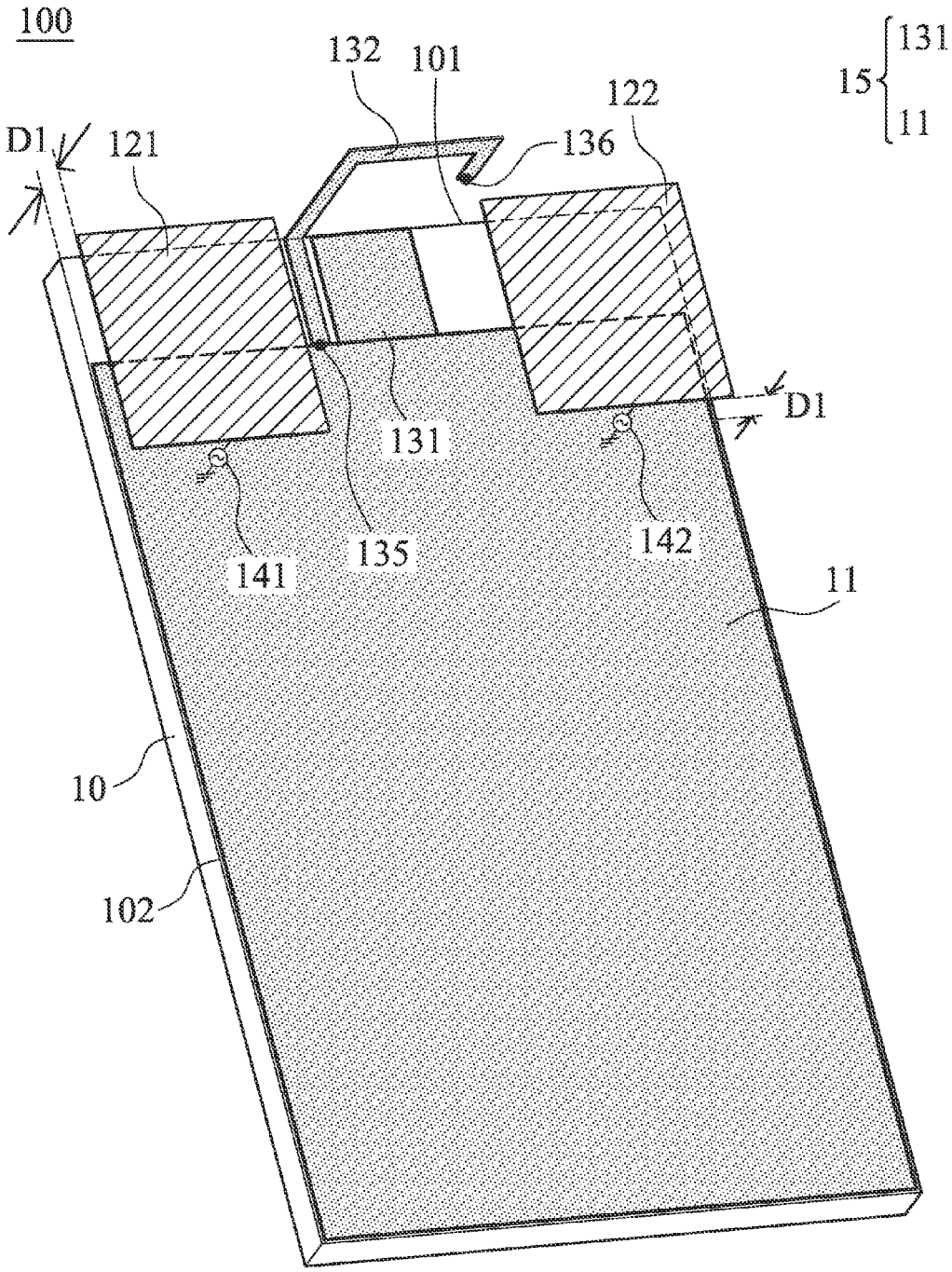
FIG. 1 is a diagram for illustrating a communication device according to an embodiment of the invention.

FIG. 1 is a diagram for illustrating a communication device 100 according to an embodiment of the invention. The communication device 100 may be a mobile device, such as a mobile phone, a tablet computer, or a notebook computer. As shown in FIG. 1, the communication device 100 at least comprises a system circuit board 10, a ground plane 11, two antennas 121 and 122, and two metal elements 131 and 132. In some embodiments, the communication device 100 may further comprise other essential components, such as a processor, a touch panel, a battery, and a housing (not shown).

The system circuit board 10 has at least two different edges 101 and 102. The edge 101 may be shorter than the edge 102. The ground plane 11 is disposed on the system circuit board 10. The ground plane 11 may be made of metal, such as copper, silver, or aluminum. The antenna 121 is electrically coupled to a signal source 141, and operates in at least a band. Similarly, the antenna 122 is electrically coupled to another signal source 142, and also operates in at least the foregoing band. The types of the antennas 121 and 122 are not restricted in the invention. For example, any of the antennas 121 and 122 may be a monopole antenna, a loop antenna, a dipole antenna, or a chip antenna. In the embodiment, the antennas 121 and 122 may have a distance D1 parallel to the system circuit board 10. However, the invention is not limited to the above. In other embodiments, any of the antennas 121 and 122 may be a printed antenna formed on a housing or the system circuit board 10, or may be an internal antenna formed inside the communication device 100.

The metal element 131 is substantially located between the antenna 121 and the antenna 122. The metal element 131 is electrically coupled to the ground plane 11 such that a system ground plane 15 is formed. More particularly, the system ground plane 15 comprises the metal element 131 and the ground plane 11, and substantially has an inverted T-shape. The antennas 121 and 122 and the metal element 131 are all substantially located at the edge 101 of the system circuit board 10. In some embodiments, each of the antennas 121 and 122 has a projection on the system circuit board 10, wherein at least a portion of the projection does not overlap with the system ground plane 15.

The metal element 132 is adjacent to the metal element 131. Generally, the metal element 132 is substantially a metal strip which is much narrower than the metal element 131. In a preferred embodiment, the metal element 132 is substantially located between the antenna 121 and the antenna 122, and is electrically coupled to the system ground plane 15. In other words, the metal element 132 may be electrically coupled to the ground plane 11 or the metal element 131. As shown in FIG. 1, the metal element 132 has two ends 135 and 136, wherein the end 135 is electrically coupled to the system ground plane 15, and the end 136 is open. The end 135 of the metal element 132 is substantially located between the antenna 121 and the metal element 131, or substantially located between the antenna 122 and the metal element 131 (not shown). In a preferred embodiment, the length of the metal element 132 is approximately equal to a quarter wavelength of a central operation frequency in the band of operation.

The metal elements 131 and 132 are configured to increase the isolation between the antennas 121 and 122 in the band of operation. When at least one of the antennas 121 and 122 resonates in the band, the metal elements 131 and 132 attract surface currents on the system ground plane 15, thereby reducing the mutual coupling between the antennas 121 and 122 and maintaining or even enhancing the antenna efficiency thereof. In some manufacturing processes, a whole metal plate is divided into the metal elements 131 and 132. In other manufacturing processes, a whole metal plate is etched to form the metal elements 131 and 132.

Figure 2:
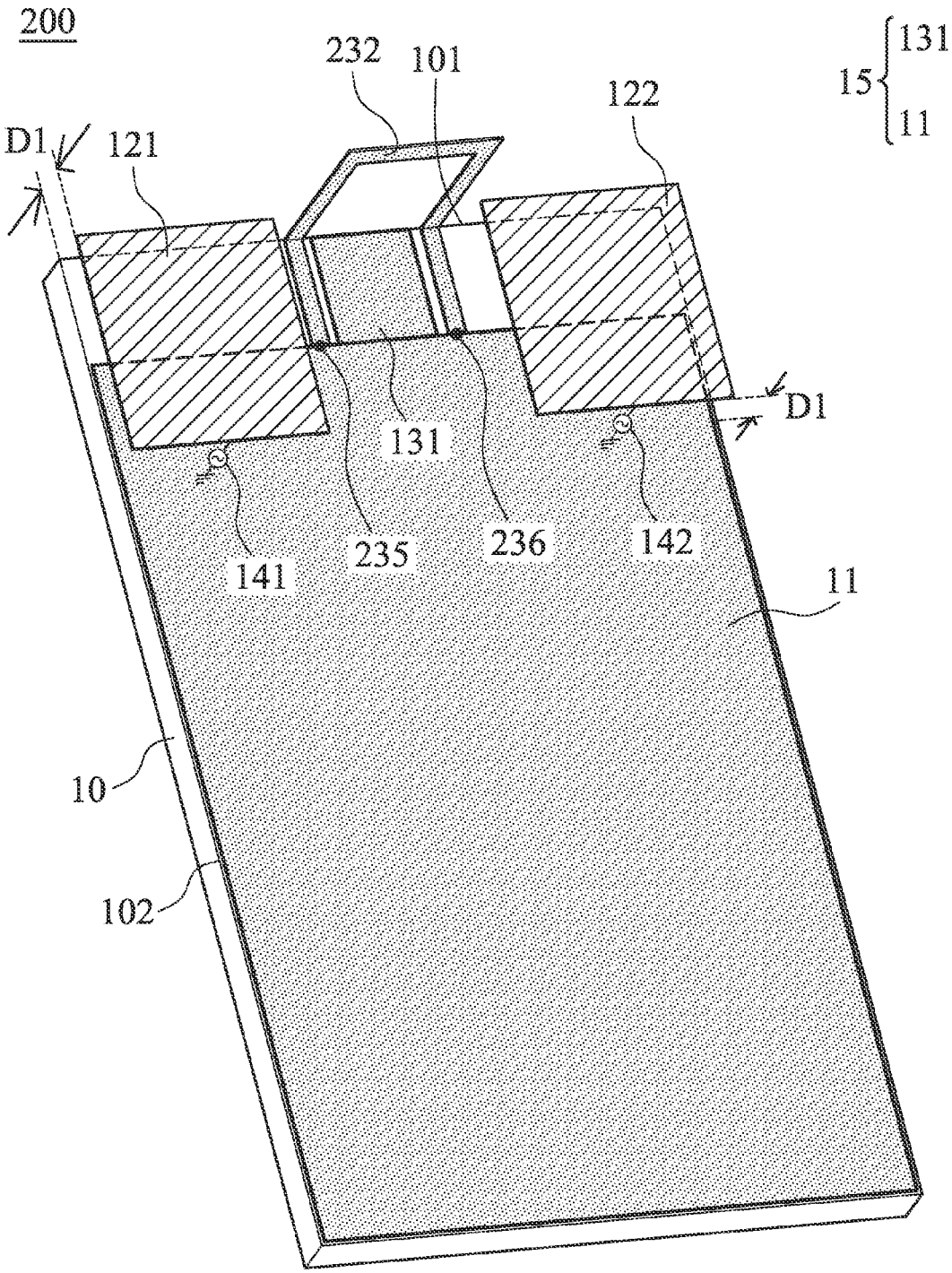
FIG. 2 is a diagram for illustrating a communication device according to an embodiment of the invention.

FIG. 2 is a diagram for illustrating a communication device 200 according to an embodiment of the invention. FIG. 2 is similar to FIG. 1. The main difference from the previous embodiment is that in the communication device 200, the metal element 132 is replaced with another metal element 232. As shown in FIG. 2, the metal element 232 has two ends 235 and 236, wherein the ends 235 and 236 are both electrically coupled to the system ground plane 15. The end 235 of the metal element 232 is substantially located between the antenna 121 and the metal element 131, and the end 236 of the metal element 232 is substantially located between the antenna 122 and the metal element 131. Accordingly, a closed loop is formed by the metal element 232 and the system ground plane 15. In a preferred embodiment, the length of the metal element 232 is approximately equal to a half wavelength of a central operation frequency in the band of operation. Similarly, the metal elements 131 and 232 are configured to increase the isolation between the antennas 121 and 122 in the band. When at least one of the antennas 121 and 122 resonates in the band, the metal elements 131 and 232 attract surface currents on the system ground plane 15, thereby reducing the mutual coupling between the antennas 121 and 122. Other features of the communication device 200 in FIG. 2 are similar to those in FIG. 1, and accordingly the two embodiments have similar performances.

According to FIGS. 1 and 2, at least a portion of the metal element 132 and at least a portion of the metal element 232 are substantially perpendicular to the system circuit board 10. However, the invention is not limited to the above. In another embodiment, each of the metal elements 132 and 232 is a planar structure. The planar structure and the metal element 131 may be disposed on a same plane.

Figure 3:
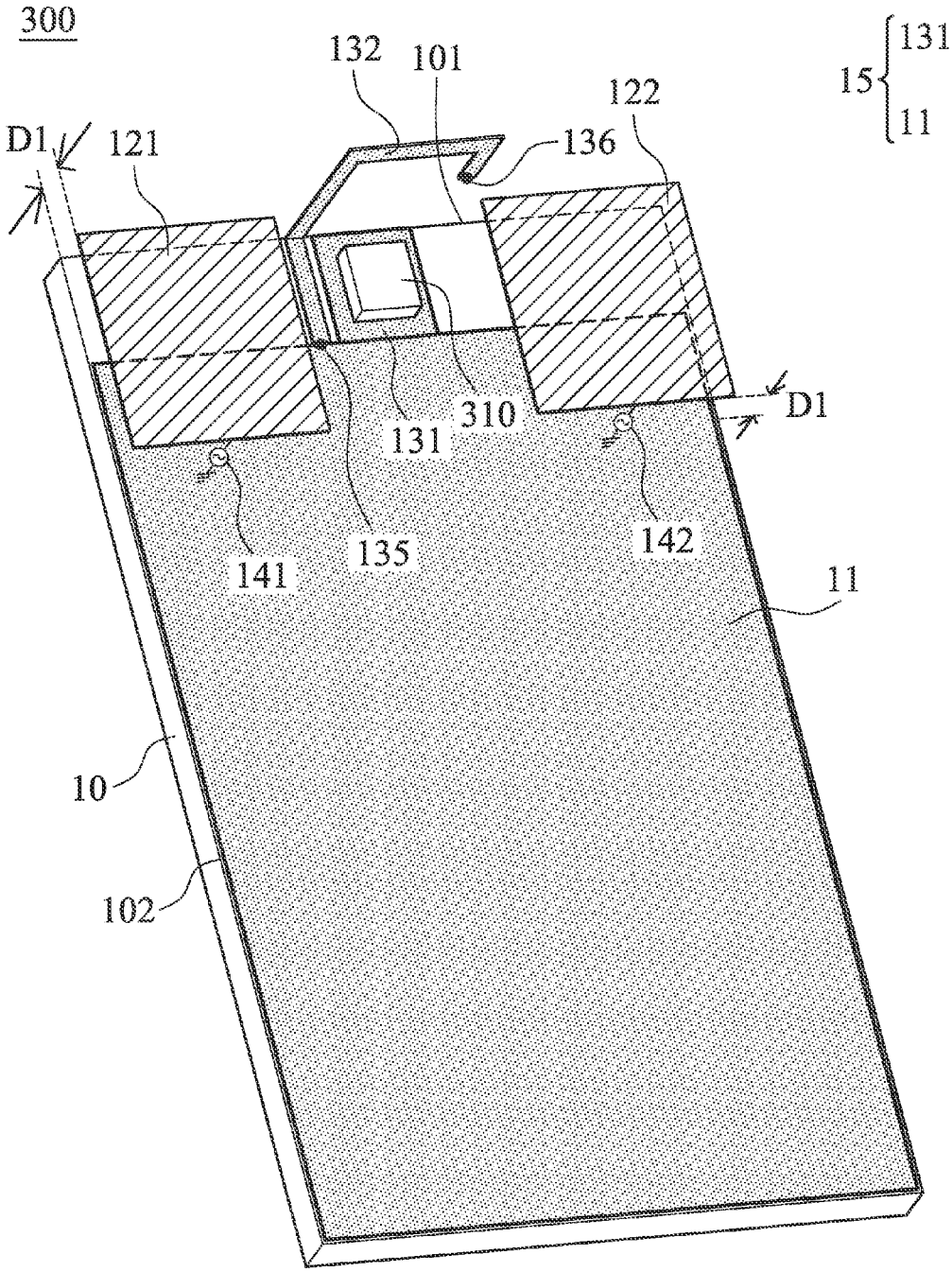
FIG. 3 is a diagram for illustrating a communication device according to an embodiment of the invention.

FIG. 3 is a diagram for illustrating a communication device 300 according to an embodiment of the invention. FIG. 3 is similar to FIG. 1. The main difference from the embodiment of FIG. 1 is that the communication device 300 further comprises an electronic component 310 which is disposed on the metal element 131. The electronic component 310 provides data transmission between the communication device 300 and an external device (not shown). In some embodiments, the electronic component 310 is a USB (Universal Serial Bus)/micro-USB socket which may be electrically coupled to a USB/micro-USB connector of the external device. Since the electronic component 310 is disposed on a portion of the system ground plane 15, the electronic component 310 does not affect the radiation efficiency of the antennas 121 and 122 very much. Other features of the communication device 300 in FIG. 3 are similar to those in FIG. 1, and accordingly the two embodiments have similar performances. Note that the electronic component 310 may also be disposed on the metal element 131 of the communication device 200 in FIG. 2.

Figure 4:
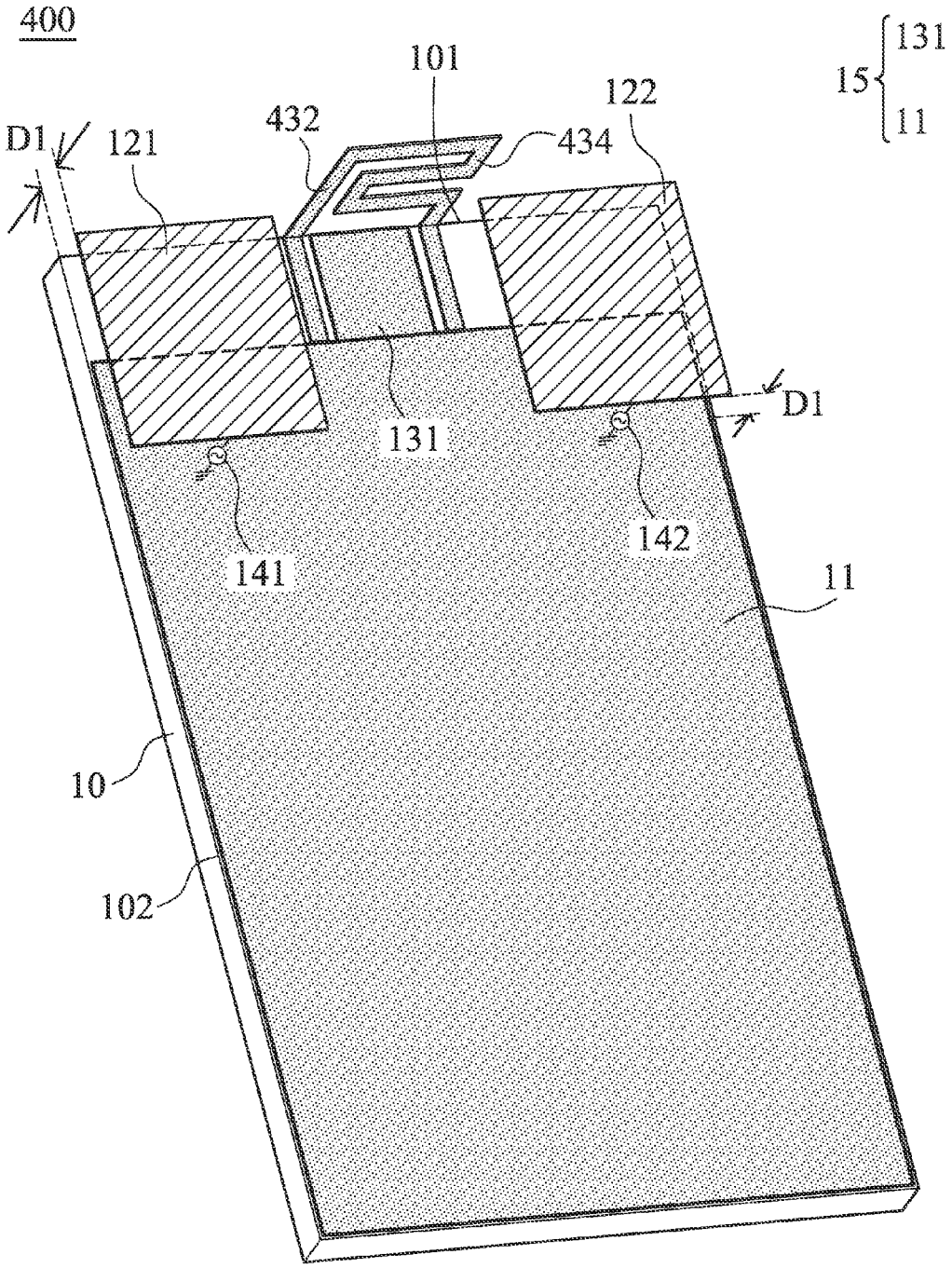
FIG. 4 is a diagram for illustrating a communication device according to an embodiment of the invention.

FIG. 4 is a diagram for illustrating a communication device 400 according to an embodiment of the invention. FIG. 4 is similar to FIG. 2. The main difference from the embodiment of FIG. 2 is that a metal element 432 of the communication device 400 has a meandering shape. The meandering shape occupies a smaller space in the communication device 400 than a straight shape does. In the embodiment, the metal element 432 comprises an inverted S-shaped portion 434. The invention is not limited to the above. In other embodiments, the metal element 432 may have other meandering shapes, such as a W-shape or an R-shape. Other features of the communication device 400 in FIG. 4 are similar to those in FIG. 2, and accordingly the two embodiments have similar performances. Note that the metal element 132 of the communication device 100 in FIG. 1 may also have a meandering shape as described above.

Figure 5:
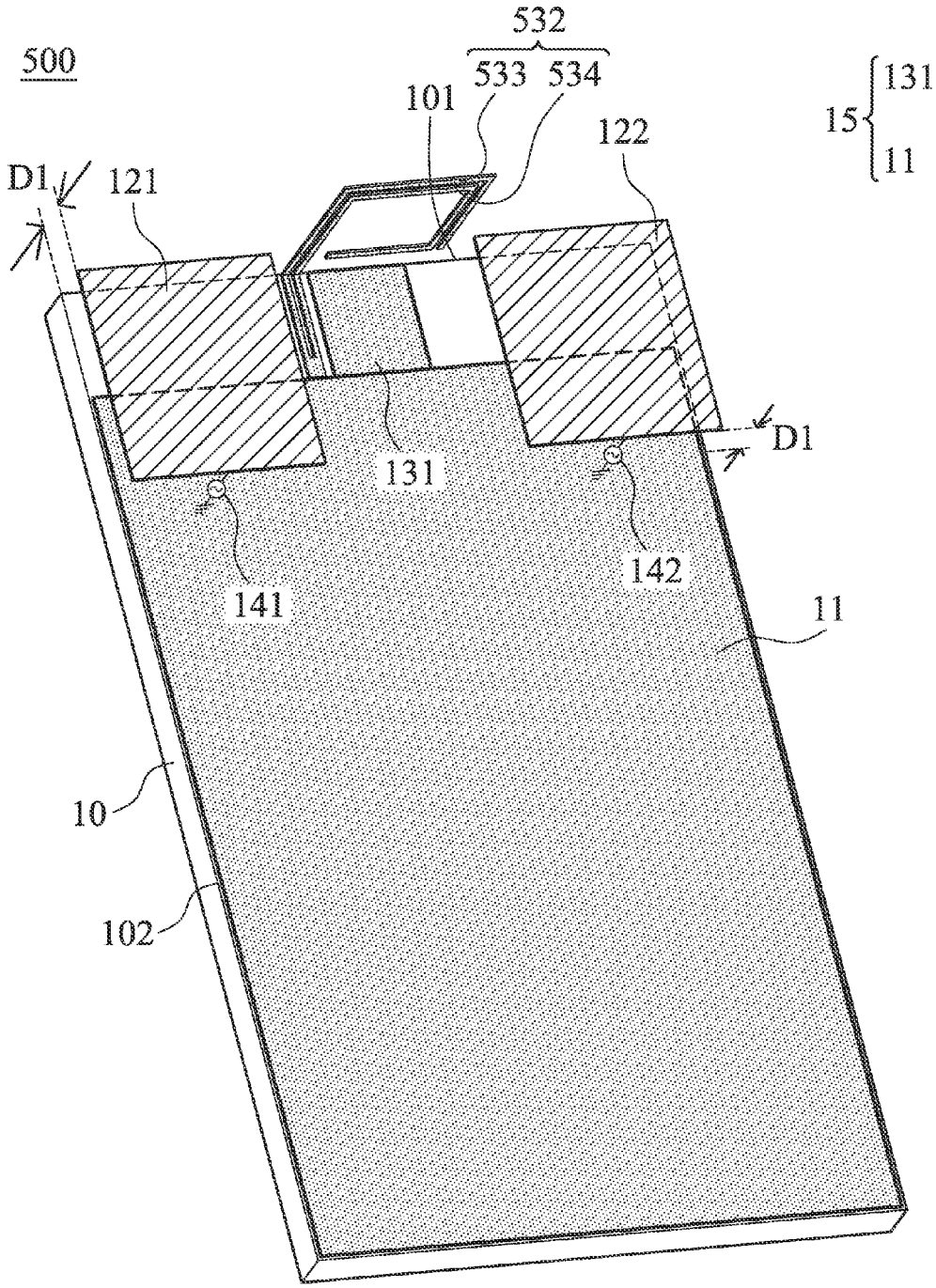
FIG. 5 is a diagram for illustrating a communication device according to an embodiment of the invention.

FIG. 5 is a diagram for illustrating a communication device 500 according to an embodiment of the invention. FIG. 5 is similar to FIG. 1. The main difference from the embodiment of FIG. 1 is that a metal element 532 of the communication device 500 comprises a plurality of metal branches 533 and 534. In some embodiments, the metal branches 533 and 534 have different lengths so as to provide isolation when at least one of the antennas 121 and 122 resonate in different bands. Note that the metal element 532 may comprise more than two metal branches although there are only two metal branches shown in FIG. 5. Other features of the communication device 500 in FIG. 5 are similar to those in FIG. 1, and accordingly, the two embodiments have similar performances.

Figure 6:
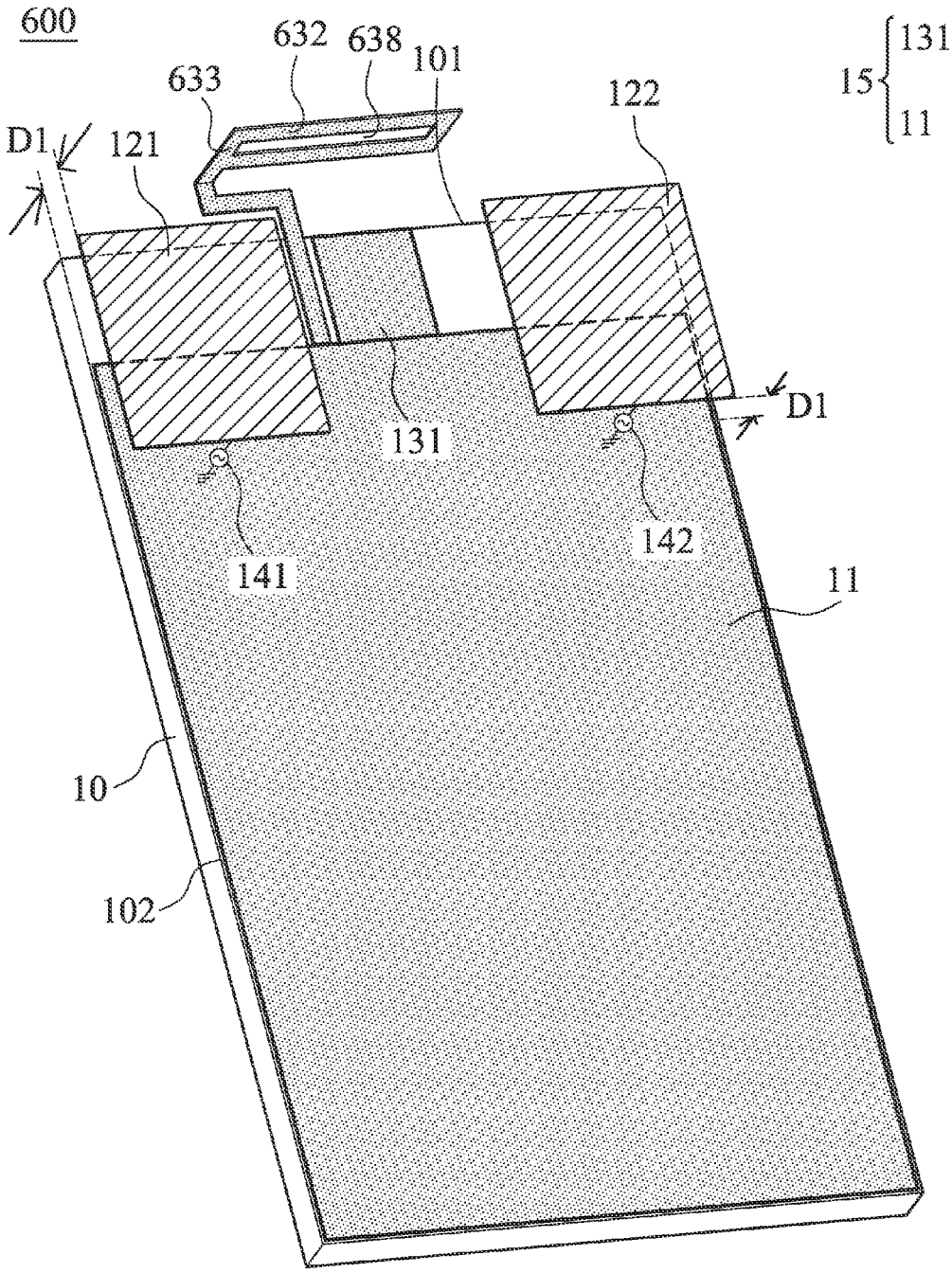
FIG. 6 is a diagram for illustrating a communication device according to an embodiment of the invention.

FIG. 6 is a diagram for illustrating a communication device 600 according to an embodiment of the invention. FIG. 6 is similar to FIG. 1. The main difference from the embodiment of FIG. 1 is that at least one opening 638 is formed in a metal element 632 of the communication device 600. The opening 638 can increase the resonant length of the metal element 632 such that the metal element 632 occupies a smaller space in the communication device 600. In the embodiment, the metal element 632 comprises a P-shaped portion 633. The invention is not limited to the above. In another embodiment, two or more openings are formed in the metal element 632. Other features of the communication device 600 in FIG. 6 are similar to those in FIG. 1, and accordingly the two embodiments have similar performances.

Figure 7:
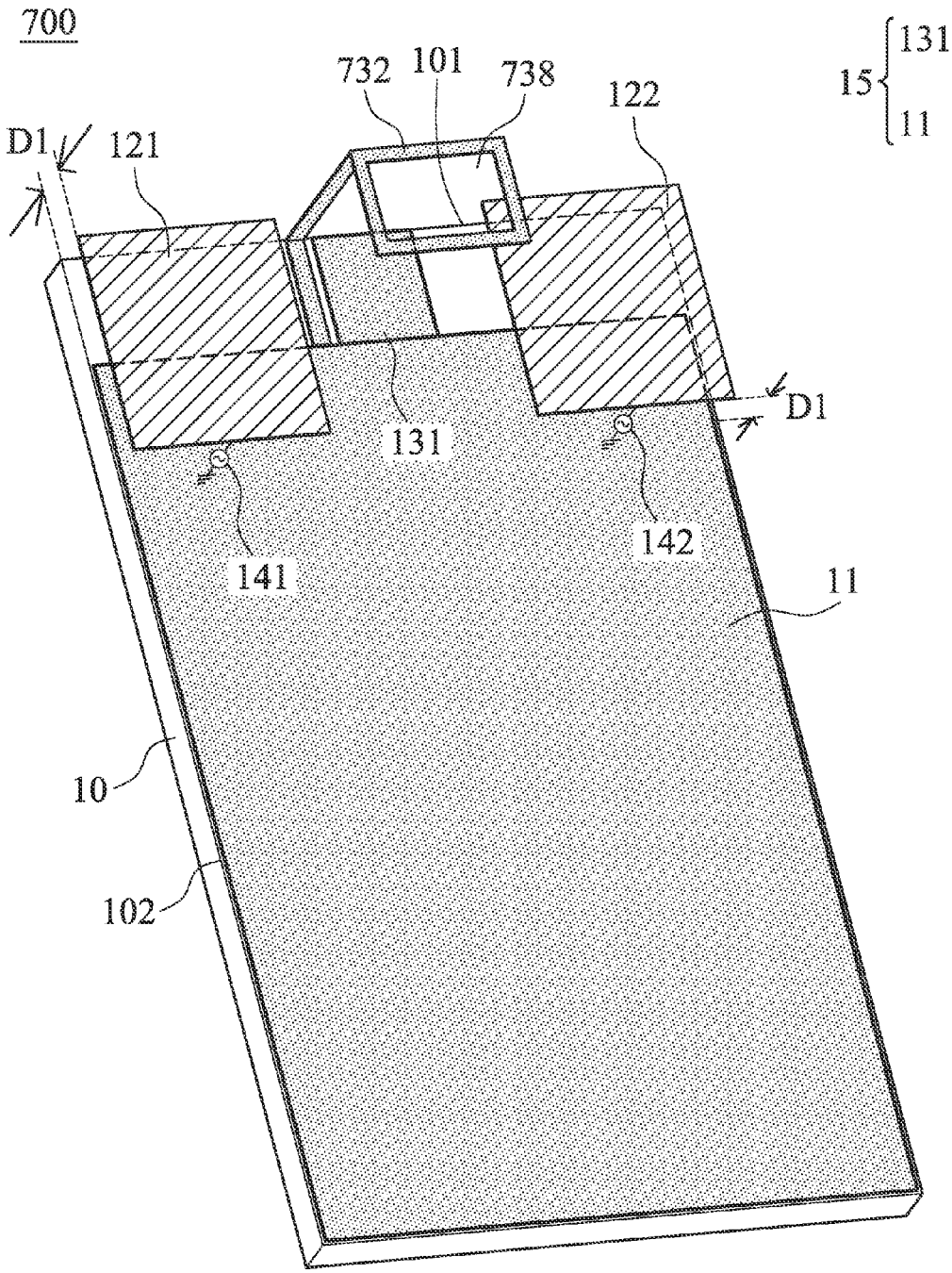
FIG. 7 is a diagram for illustrating a communication device according to an embodiment of the invention.

FIG. 7 is a diagram for illustrating a communication device 700 according to an embodiment of the invention. FIG. 7 is similar to FIG. 1. The main difference from the embodiment of FIG. 1 is that in the communication device 700, at least a portion of a metal element 732 is substantially above another metal element 131. In other words, the metal element 732 has a projection on the system circuit board 10, and the projection partially overlaps the metal element 131. As shown in FIG. 7, an opening 738 is formed in the portion of the metal element 732 above the metal element 131. The invention is not limited to the above. In another embodiment, a metal element 732 without any openings may be formed above the metal element 131. Other features of the communication device 700 in FIG. 7 are similar to those in FIG. 1, and accordingly the two embodiments have similar performances.

Figure 8A:
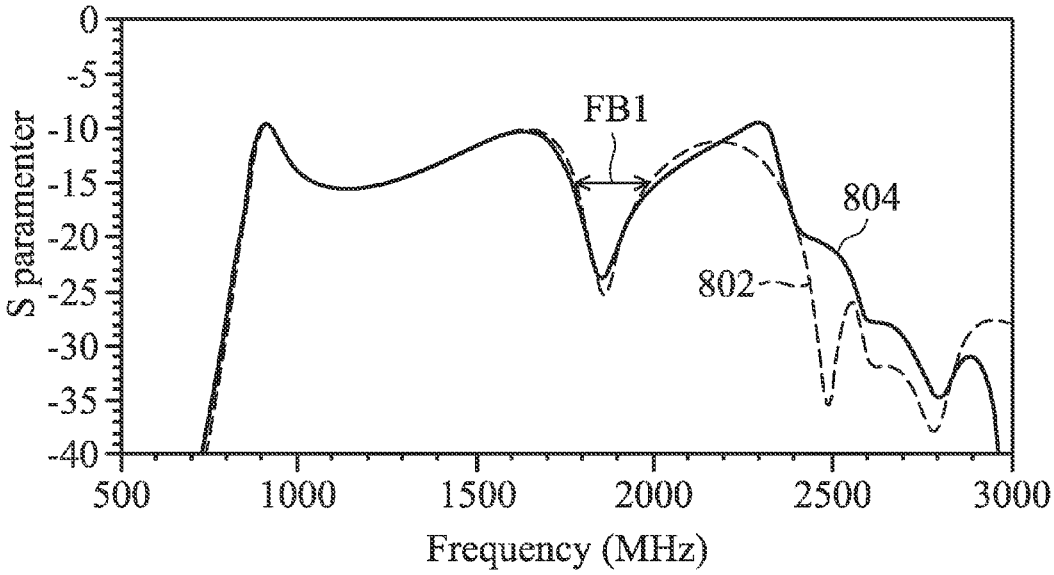
FIG. 8A is a diagram for illustrating S parameters of antennas according to an embodiment of the invention.

FIG. 8A is a diagram for illustrating S parameters of the antennas 121 and 122 according to an embodiment of the invention. The horizontal axis represents the operation frequency (MHz), and the vertical axis represents the S parameters (dB). The curve 802 represents the isolation (S21) between the antennas 121 and 122 of the communication device 100 in FIG. 1, and the curve 804 represents the isolation (S21) between the antennas 121 and 122 of the communication device 200 in FIG. 2. In the embodiment, the antennas 121 and 122 may both operate in a band FB1. As shown in FIG. 8A, the isolation (S21) is improved down to at least −15 dB in the band FB1 when the metal element 131 and either the metal element 132 or the metal element 232 are incorporated into the communication device. According to FIG. 8A, the metal element 132 shown in FIG. 1 and the metal element 232 shown in FIG. 2 almost have the same effects which improve the isolation. In some embodiments, the band FB1 is approximately from 1710 MHz to 1990 MHz.

Figure 8B:
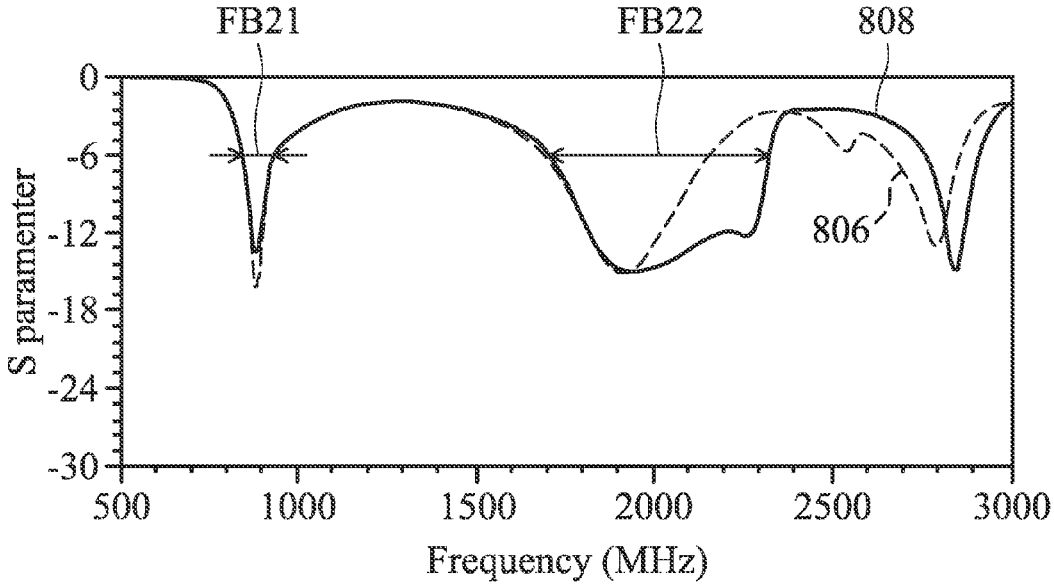
FIG. 8B is a diagram for illustrating S parameters of an antenna according to an embodiment of the invention.

FIG. 8B is a diagram for illustrating S parameters of the antenna 121 according to an embodiment of the invention. The horizontal axis represents the operation frequency (MHz), and the vertical axis represents the S parameters (dB). The curve 806 represents the reflection coefficient (S11) of the antenna 121 of the communication device 100 in FIG. 1, and the curve 808 represents the reflection coefficient (S11) of the antenna 121 of the communication device 200 in FIG. 2. As shown in FIG. 8B, the antenna 121 further operates in two bands FB21 and FB22. In some embodiments, the band FB21 is approximately from 824 MHz to 960 MHz, and the band FB22 is approximately from 1710 MHz to 2170 MHz.

Figure 8C:
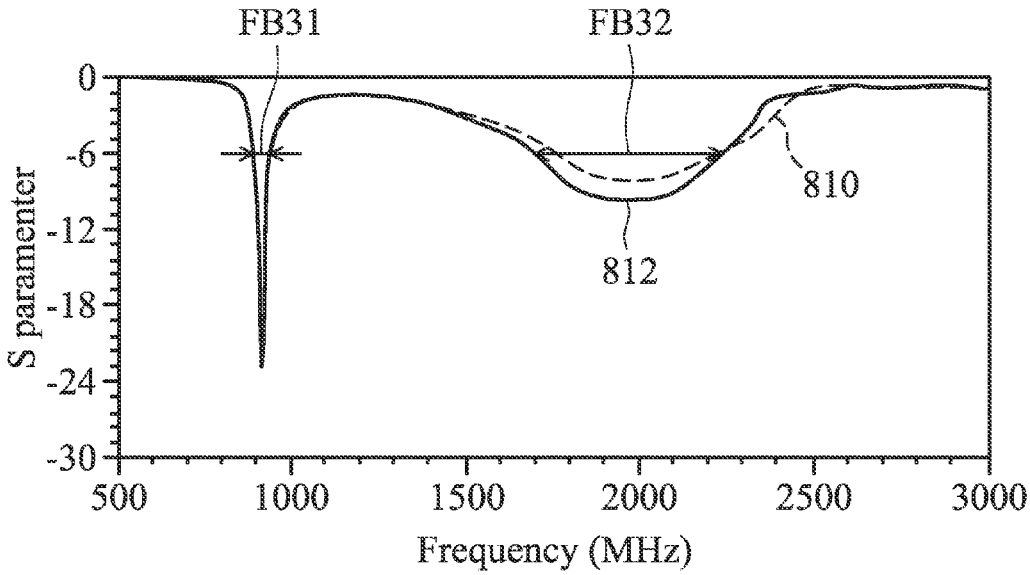
FIG. 8C is a diagram for illustrating S parameters of an antenna according to an embodiment of the invention.

FIG. 8C is a diagram for illustrating S parameters of the antenna 122 according to an embodiment of the invention. The horizontal axis represents the operation frequency (MHz), and the vertical axis represents the S parameters (dB). The curve 810 represents the reflection coefficient (S22) of the antenna 122 of the communication device 100 in FIG. 1, and the curve 812 represents the reflection coefficient (S22) of the antenna 122 of the communication device 200 in FIG. 2. As shown in FIG. 8C, the antenna 122 further operates in two bands FB31 and FB32. In some embodiments, the band FB31 is approximately from 880 MHz to 960 MHz, and the band FB32 is approximately from 1710 MHz to 1990 MHz.

The forgoing frequency ranges of the bands shown in FIGS. 8A-8C are not limitations of the invention. An antenna designer can adjust the frequency ranges of the bands according to different requirements.

Figure 9A:
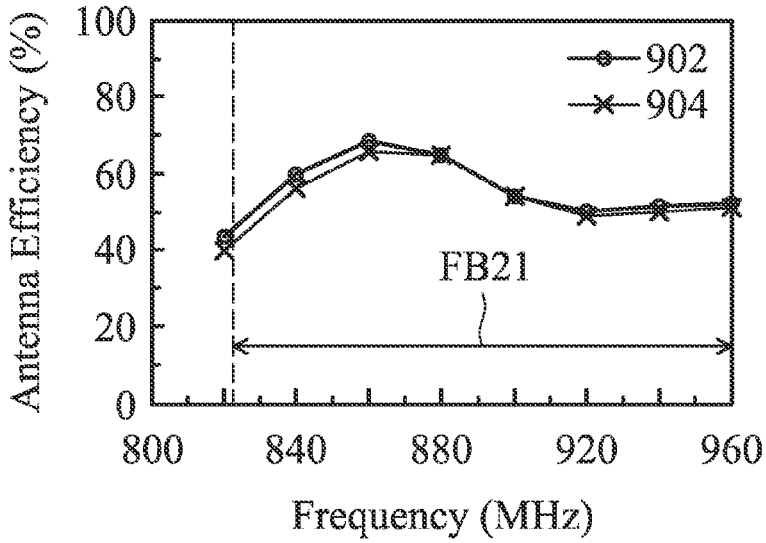
FIG. 9A is a diagram for illustrating antenna efficiency of an antenna according to an embodiment of the invention.

FIG. 9A is a diagram for illustrating the antenna efficiency of the antenna 121 according to an embodiment of the invention. The horizontal axis represents the operation frequency (MHz), and the vertical axis represents the antenna efficiency (%). For comparison, the curve 902 represents the antenna efficiency of the antenna 121 of the communication device in a mentioned embodiment, and the curve 904 represents the antenna efficiency of the antenna 121 of another communication device without any metal elements. As shown in FIG. 9A, the antenna efficiency of the antenna 121 is barely changed in the low band FB21 when metal elements are incorporated into the communication device.

Figure 9B:
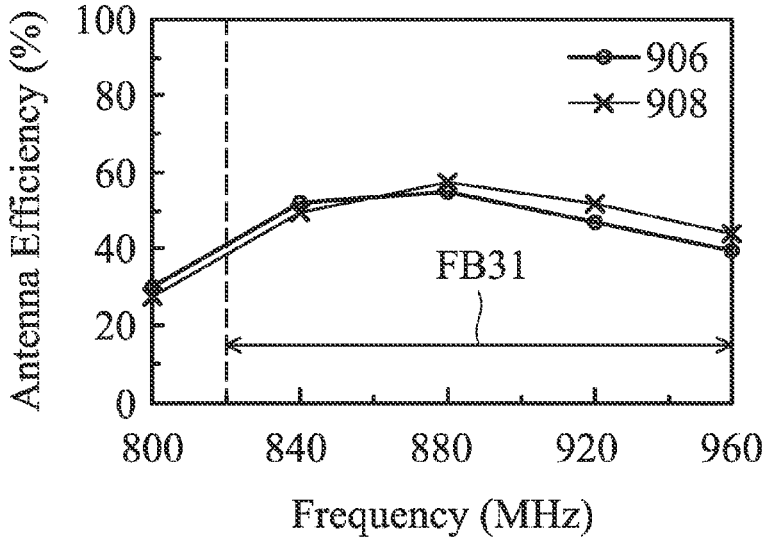
FIG. 9B is a diagram for illustrating antenna efficiency of an antenna according to an embodiment of the invention.

FIG. 9B is a diagram for illustrating the antenna efficiency of the antenna 122 according to an embodiment of the invention. The horizontal axis represents the operation frequency (MHz), and the vertical axis represents the antenna efficiency (%). For comparison, the curve 906 represents the antenna efficiency of the antenna 122 of the communication device in a mentioned embodiment, and the curve 908 represents the antenna efficiency of the antenna 122 of another communication device without any metal elements. As shown in FIG. 9B, the antenna efficiency of the antenna 122 is barely changed in the low band FB31 when the metal elements are incorporated into the communication device.

Figure 9C:
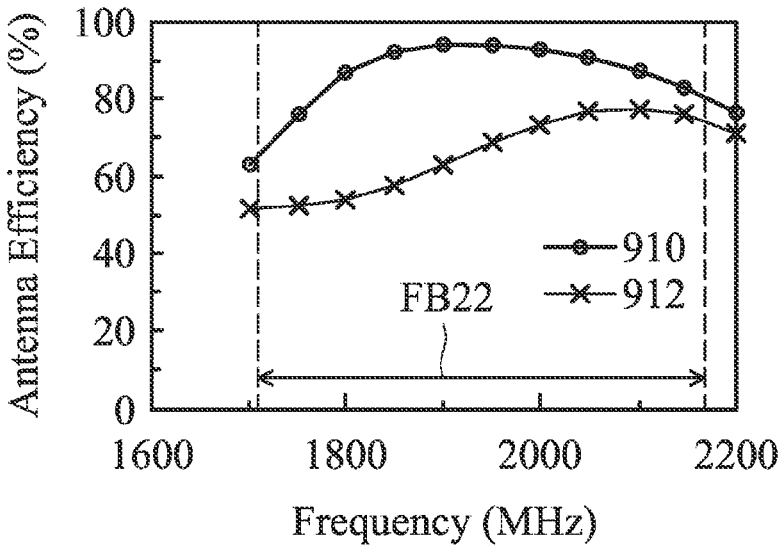
FIG. 9C is a diagram for illustrating antenna efficiency of an antenna according to an embodiment of the invention.

FIG. 9C is a diagram for illustrating the antenna efficiency of the antenna 121 according to an embodiment of the invention. The horizontal axis represents the operation frequency (MHz), and the vertical axis represents the antenna efficiency (%). For comparison, the curve 910 represents the antenna efficiency of the antenna 121 of the communication device in a mentioned embodiment, and the curve 912 represents the antenna efficiency of the antenna 121 of another communication device without any metal elements. As shown in FIG. 9C, the antenna efficiency of the antenna 121 is apparently increased in the high band FB22 when the metal elements are incorporated into the communication device.

Figure 9D:
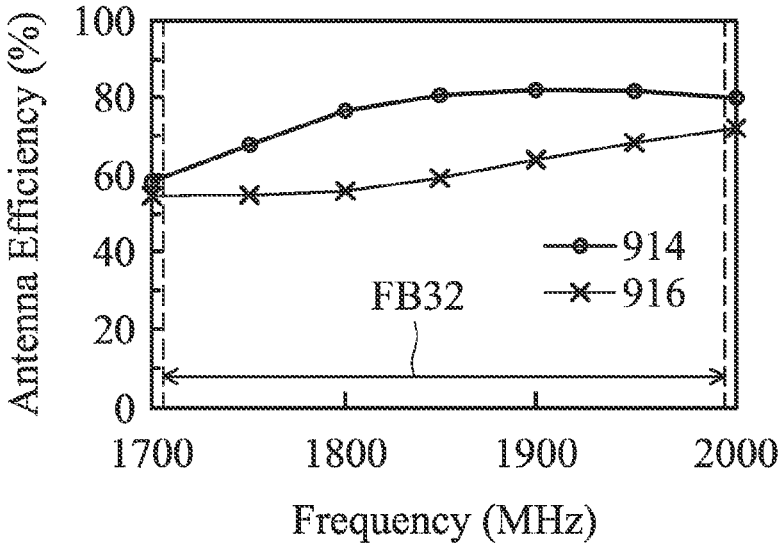
FIG. 9D is a diagram for illustrating antenna efficiency of an antenna according to an embodiment of the invention.

FIG. 9D is a diagram for illustrating the antenna efficiency of the antenna 122 according to an embodiment of the invention. The horizontal axis represents the operation frequency (MHz), and the vertical axis represents the antenna efficiency (%). For comparison, the curve 914 represents the antenna efficiency of the antenna 122 of the communication device in a mentioned embodiment, and the curve 916 represents the antenna efficiency of the antenna 122 of another communication device without any metal elements. As shown in FIG. 9D, the antenna efficiency of the antenna 122 is apparently increased in the high band FB32 when the metal elements are incorporated into the communication device.

In the invention, two metal elements are applied to a communication device to increase isolation between antennas. One metal element is substantially a portion of a system ground plane to separate the antennas, and another metal element is substantially a metal strip to resonate in a specific band. The invention has at least the following advantages: (1) the isolation between the antennas is effectively improved in at least one band; (2) the frequency range of the band for isolation is adjustable; (3) the antenna efficiency is maintained in a low band and is enhanced in a high band; and (4) the impedance matching is improved in the high band.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A communication device, comprising:

a system circuit board, having a first edge;

a ground plane, disposed on the system circuit board;

a first antenna, coupled to a first signal source, and operating in at least a first band;

a second antenna, coupled to a second signal source, and operating in at least the first band;

a first metal element, substantially located between the first antenna and the second antenna, wherein the first metal element is coupled to the ground plane such that a system ground plane is formed with a substantially T-shape; and a second metal element, adjacent to the first metal element, substantially located between the first antenna and the second antenna, and coupled to the system ground plane, wherein the first antenna, the second antenna, and the first metal element are substantially located at the first edge of the system circuit board, and a first end of the second metal element is located substantially between the first antenna and the first metal element.

2. The communication device as claimed in claim 1, wherein the second metal element has a second end, and the first end is coupled to the system ground plane, and the second end is open.

3. The communication device as claimed in claim 2, wherein a length of the second metal element is approximately equal to a quarter wavelength of a central operation frequency in the first band.

4. The communication device as claimed in claim 1, wherein the second metal element has a second end, and the first end and the second end are coupled to the system ground plane such that a closed loop is formed by the second metal element and the system ground plane.

5. The communication device as claimed in claim 4, wherein a length of the second metal element is approximately equal to a half wavelength of a central operation frequency in the first band.

6. The communication device as claimed in claim 4, wherein the second end of the second metal element is substantially located between the second antenna and the first metal element.

7. The communication device as claimed in claim 1, further comprising:

an electronic component, disposed on the first metal element.

8. The communication device as claimed in claim 7, wherein the electronic component provides data transmission between the communication device and an external device.

9. The communication device as claimed in claim 1, wherein the second metal element comprises a plurality of metal branches.

10. The communication device as claimed in claim 1, wherein at least one opening is formed in the second metal element.

11. The communication device as claimed in claim 1, wherein at least a portion of the second metal element is substantially perpendicular to the system circuit board, or the second metal element is a planar structure which is disposed on a same plane with the first metal element.

12. The communication device as claimed in claim 1, wherein a portion of the second metal element is substantially above the first metal element.

13. The communication device as claimed in claim 1, wherein the system circuit board further has a second edge, and the first edge is shorter than the second edge.

14. The communication device as claimed in claim 1, wherein the first metal element and the second metal element are configured to increase isolation between the first antenna and the second antenna in the first band.

15. The communication device as claimed in claim 1, wherein the first antenna has a first projection on the system circuit board, and at least a portion of the first projection does not overlap with the system ground plane.

16. The communication device as claimed in claim 1, wherein the second antenna has a second projection on the system circuit board, and at least a portion of the second projection does not overlap with the system ground plane.

17. The communication device as claimed in claim 1, wherein the first band is approximately from 1710 MHz to 1990 MHz.

18. The communication device as claimed in claim 1, wherein the first antenna further operates in a second band which is approximately from 824 MHz to 960 MHz and from 1710 MHz to 2170 MHz.

19. The communication device as claimed in claim 1, wherein the second antenna further operates in a third band which is approximately from 880 MHz to 960 MHz and from 1710 MHz to 1990 MHz.

20. The communication device as claimed in claim 1, wherein the first antenna partially covering the system circuit board and partially covering the ground plane, and the second antenna partially covering the system circuit board and partially covering the ground plane.

* * * * *